US006507987B1

(12) United States Patent
Price

(10) Patent No.: US 6,507,987 B1
(45) Date of Patent: Jan. 21, 2003

(54) GREASE FILTER REMOVER FOR RESTAURANT HOODS

(76) Inventor: James L. Price, 1831 Fairview St., Burlington, NC (US) 27215

( * ) Notice: Subject to any disclaimer, the term of this patent is extended or adjusted under 35 U.S.C. 154(b) by 0 days.

(21) Appl. No.: 09/699,575

(22) Filed: Oct. 31, 2000

(51) Int. Cl.[7] ..... B66F 3/00
(52) U.S. Cl. ..... 29/278
(58) Field of Search ..... 259/129, 130, 259/131; 269/69, 296; 29/167, 278

(56) References Cited

U.S. PATENT DOCUMENTS 1,375,751 A * 4/1921 Grannis ..... 254/129
3,048,387 A * 8/1962 Waggoner ..... 269/69
5,832,581 A * 11/1998 Barthuli ..... 29/267

* cited by examiner

*Primary Examiner*—Robert C. Watson
(74) *Attorney, Agent, or Firm*—Womble Carlyle Sandridge & Rice, PLLC

(57) ABSTRACT

A single purpose hand held tool, having a long tubular handle with a pivoting fork grasping device attached perpendicular to the handle by a pivoting support plate. The support plate attaches to four forks extending out parallel to the plate. The top forks extend out 90 degrees upward while the lower forks splay out 60 degrees downward. The forks and support plate are attached to the end of the handle with a removable pin. The forks and support plate pivot to different angles to match the slope of the baffle filter in the kitchen exhaust hood of a restaurant. The support plate pivots through a lot cut in the end of the handle, and is set or locked in place by means of a removable pin. The pin allows the angle of the forks to vary, and is removable to allow the tool to be mounted flat against the wall on a hook or hanger. The top forks of the tool insert under the edge of the baffle lip or turned down edge of the baffle filter housing, and the lower forks support the weight of the filter assembly. The top forks have a 5-degree bend at their ends to create a wedge or locking effect on the filter assembly between the baffles or turned down edge of the assembly. By the user applying an upward force with the tool, the top fingers slip under the baffle's lip, while the bottom fork support the weight and stabilize the filter assembly. The user can thus remove, clean, and replace the filter while standing safely on the floor.

2 Claims, 3 Drawing Sheets

GREASE FILTER REMOVER FOR RESTAURANT HOODS

BACKGROUND OF THE INVENTION

1) Field of the Invention

This invention relates to a single purpose tool used to remove and replace grease filters safely and easily, in restaurant kitchen exhaust hoods.

2) Description of the Prior Art

All restaurants are required to have exhaust hoods over heated cooking appliances such as grills, stoves, griddles, ovens and deep flyers. The typical restaurant kitchen exhaust hood has a number of metal, baffle style or mesh style filters inserted up into the hood in a track, and the filters trap and hold grease and dirt particles. The filters prevent the grease from plugging up the exhaust fan or causing a fire hazard. These older style mesh or newer style baffle filters are placed into a track, which matches the slope of the exhaust hood. These metal filters have to be removed, cleaned and replaced regularly to insure compliance with both health and safety standards. Typically, someone standing on or over these heated cooking appliances removes these greasy, dirty filters by hand, for cleaning, which is usually both difficult and dangerous to do. Further, this process often contaminates food-cooking surfaces, if grease drips off them while the filters are being removed. This often requires additional cleaning and decontamination of the appliance or cooking area.

SUMMARY OF THE INVENTION

The present invention provides a pivoting tool at the end of a handle that has forks designed to catch and hold either wire mesh or baffle style filters. The tool allows a person standing on the floor to reach up into the exhaust hood, and catch the lip of the baffle filter or support frame. By applying an upward force, the user inserts the forks of the invention into the lip of the filter. The filter can thus be lifted and removed, cleaned, and then reinserted into the tracks in the hood. The person using this tool may stand safely on the floor, instead of trying to climb on top of hot or otherwise sanitary cooking surfaces. Another aspect of the invention is the pivoting support plate. Since the slope of the inside of an exhaust hood depends upon it's size and design, the invention can pivot to various angles, from zero to 90 degrees, to match the slope of the support track and baffle filter. This allows the invention to remove any size or type of restaurant exhaust hood filter.

DETAILED DESCRIPTION OF THE PREFERRED EMBODIMENT

Figure 1:
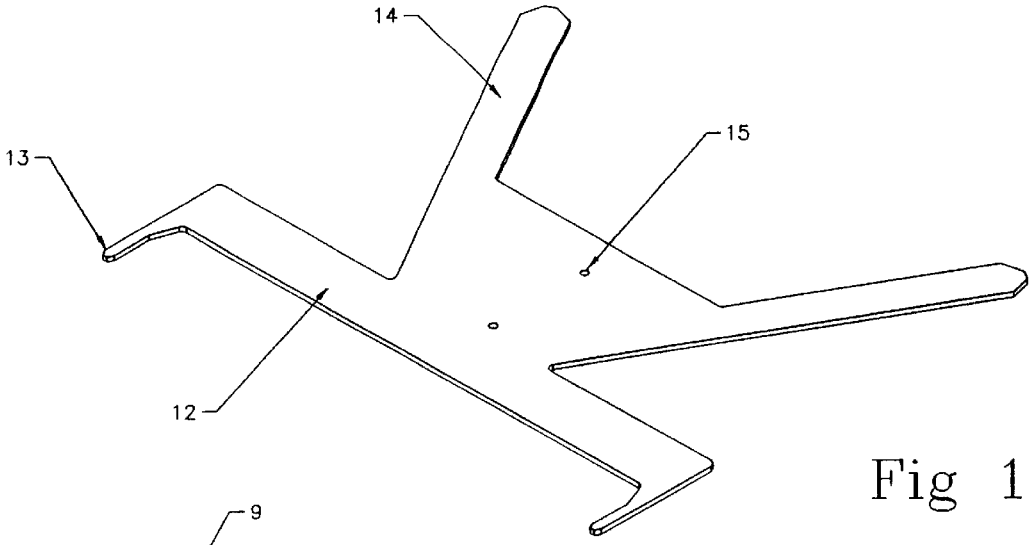
FIG. 1 is a perspective view of the fork member of the invention.
Figure 2:
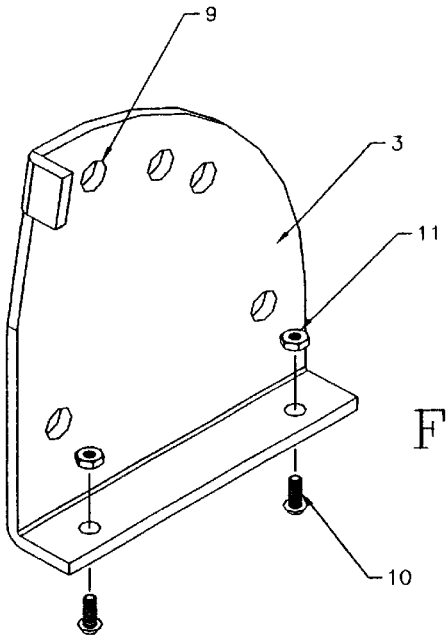
FIG. 2 is a perspective view of the support plate.
Figure 3:
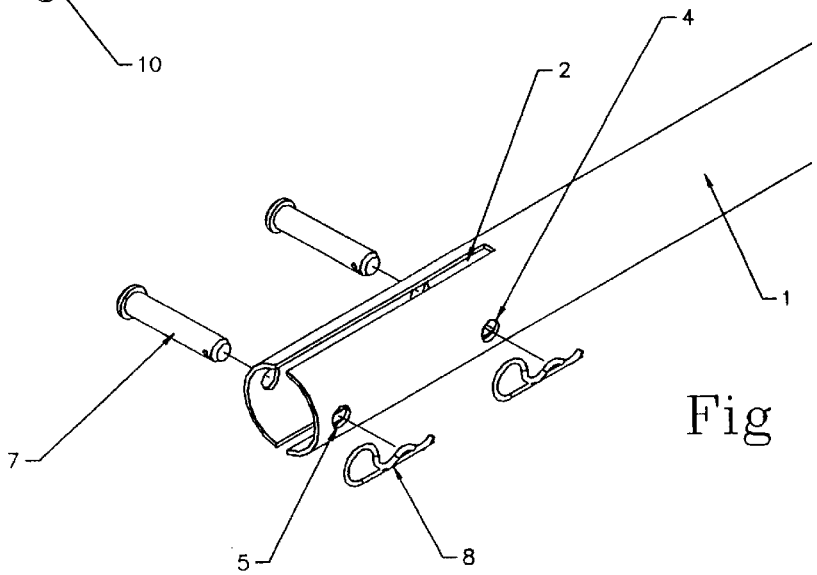
FIG. 3 is a perspective view of the end portion of the handle.
Figure 4:
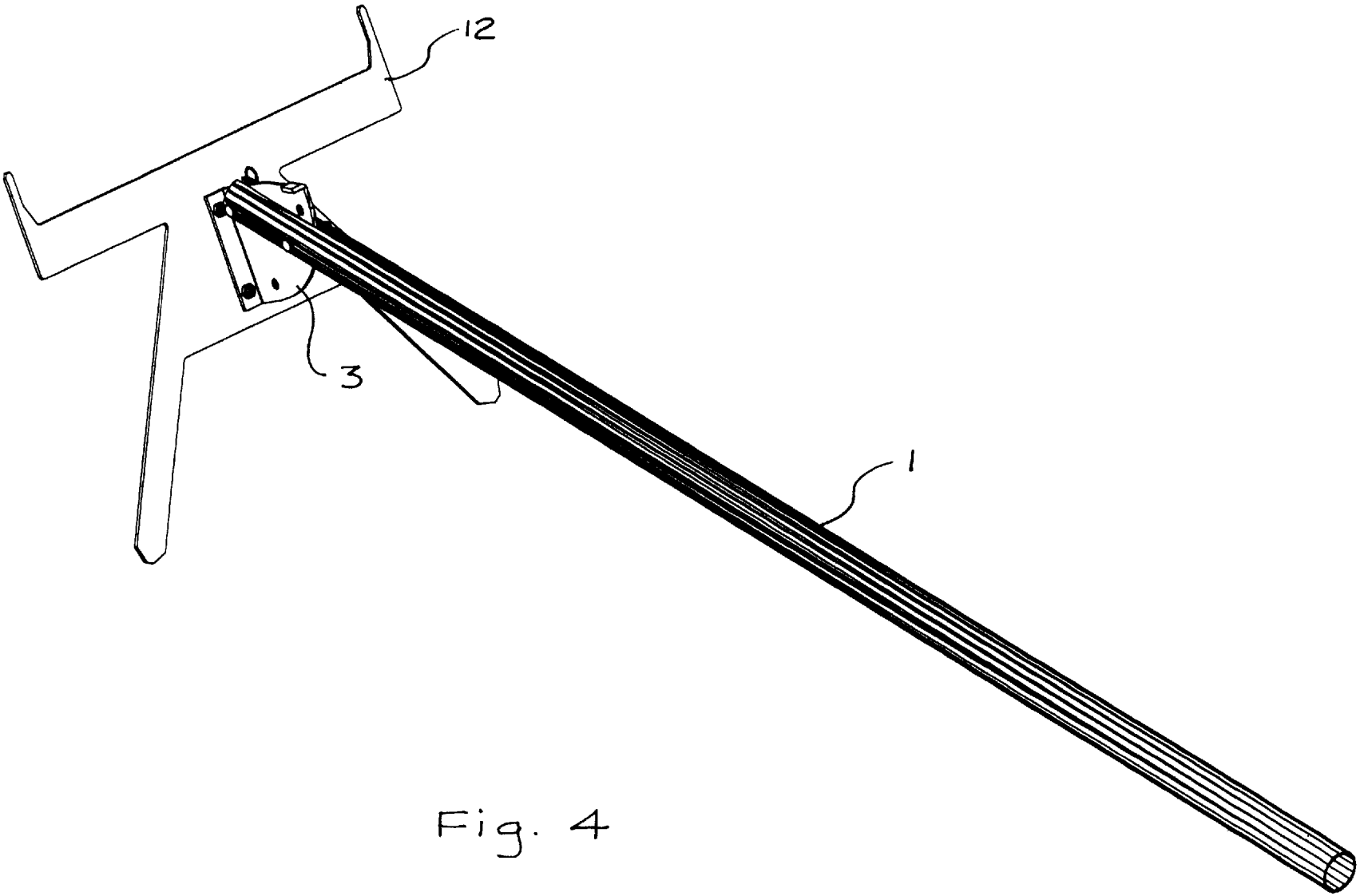
FIG. 4 is a perspective view of the assembled tool according to the present invention.
Figure 6:
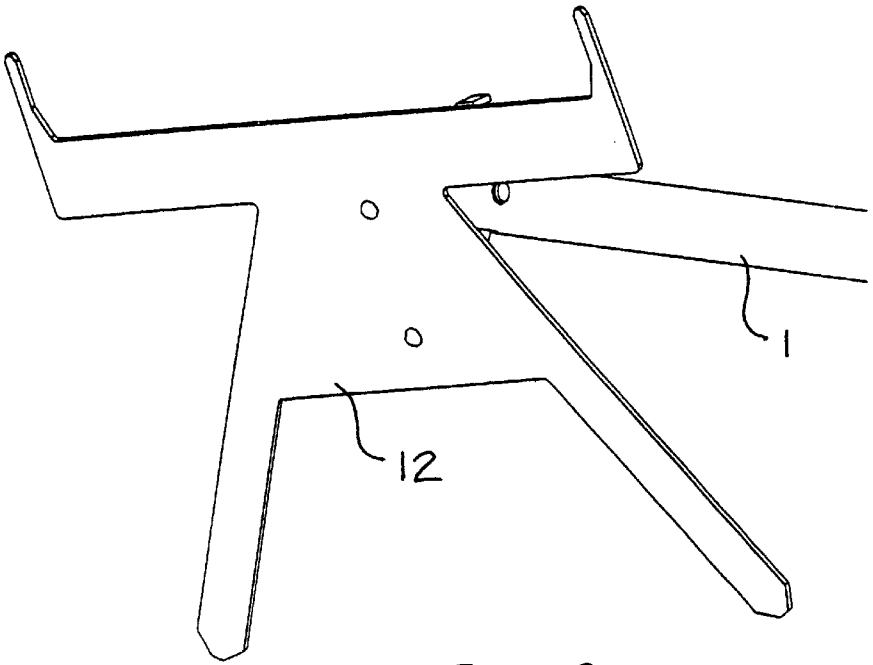
FIG. 6 is a perspective view of the front side of the end portion of the assembled tool.
Figure 5:
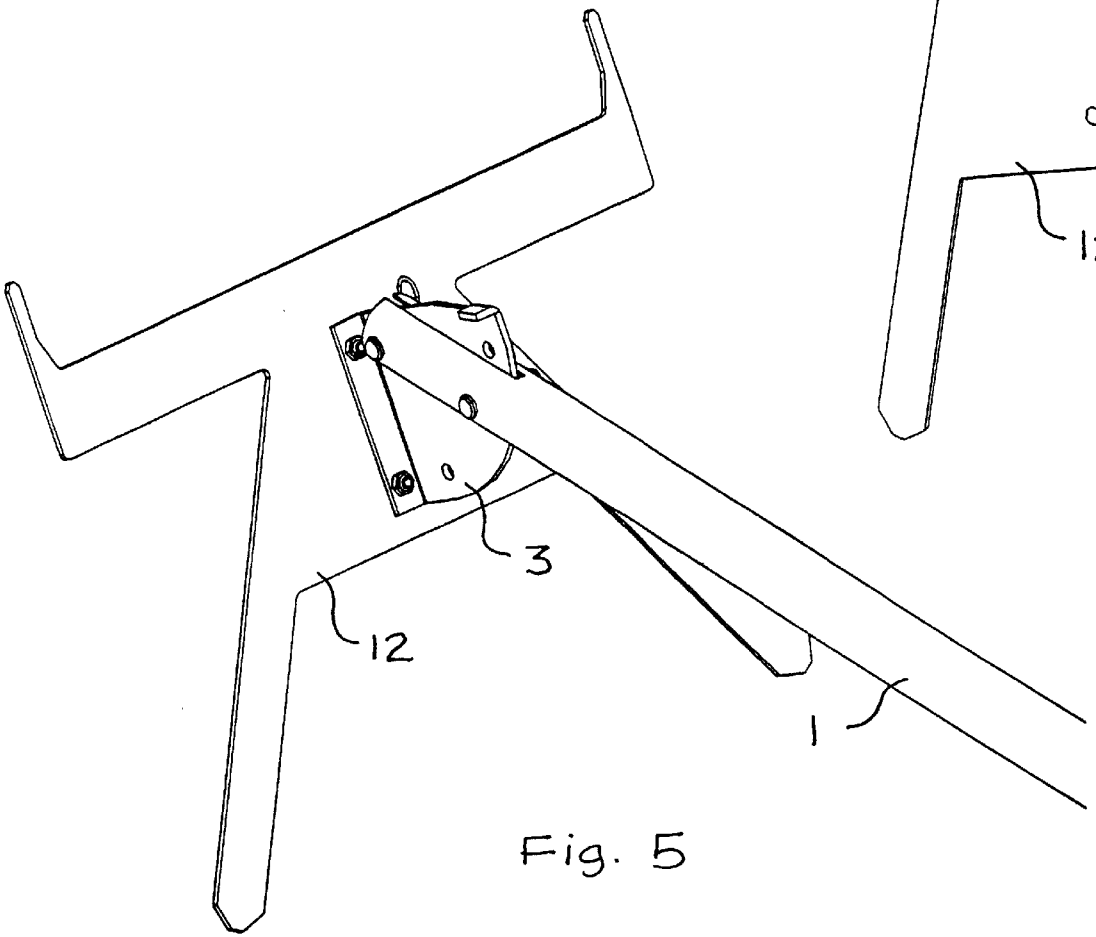
FIG. 5 is a perspective view of the rear side of the end portion of the assembled tool.

The principles of the invention are described with reference to the handle (1), as shown in FIG. 3. It is an elongated metal tubular handle (1) that is slotted (2) at one end to allow the pivoting fork support plate (3) (FIG. 2) to swing from 0 degrees to 90 degrees. The handle has two holes drilled through it (4, 5) 90 degrees perpendicular to the slot. The holes have removable clevis pins (7) and hitch pins (8) to allow the support plate (3) to pivot and then be locked in place. The support plate (3) has four holes (9), which correspond to different angles. The fork assembly (FIG. 1) (12) is bolted (10) to the support plate (3). The upward fingers (13) are bent forward 5 degrees to catch the lip of the baffle filter. The lower forks (14) extend downward and outward 60 degrees to support the weight of the filter itself. The lower hitch pin may be removed completely to allow the tool t be placed flat against the wall.

I claim:

1. A tool for removing and replacing exhaust hood grease filters of the type having a peripheral frame with lips supporting a pad of filter media therein, said tool comprising:

a) a fork member having a substantially flat portion for supporting the weight of the filter during removal and insertion and at least two spaced fingers extending upwardly from an upper portion thereof;

b) an elongated handle member; and c) a support bracket attached to the rear of said fork member and being so configured as to adjustably attach the handle member at various selected angles with respect to the fork member;

d) wherein:

(i) the support bracket comprises a plate member having an attachment flange for attaching the plate to the surface of the fork member in such a manner that the plate extends substantially perpendicular to the surface of the fork member, the plate member also being provided with an upper opening adjacent the surface of the fork member and an arcuate array of openings in the plate all equidistant from the upper opening;

(ii) the elongated handle member includes a diametrical slot extending inwardly from one end and at least two pair of aligned openings extending transversely through the handle member perpendicular to the slot; and (iii) at least two releasable pin type fasteners are provided;

(iv) whereby the handle member is angularly attached to the fork member by inserting the plate member of the support bracket into the slot in the handle member and attaching one of the fasteners through one pair of the aligned openings in the handle and the upper opening and a second fastener through the other pair of aligned openings in the handle member and one of the openings in the accurate pattern to secure the handle at a prescribed selected angle with respect to the fork member;

e) whereby when the fingers of the fork member are inserted beneath the lip of the peripheral frame, the filter may be lifted and removed from the exhaust hood with the weight of the grease filter carried by the lower flat portion of the fork member.

2. A tool for removing and replacing exhaust hood grease filters of the type having a peripheral frame with lips supporting a pad of filter media therein, said tool comprising:

a) a fork member having a substantially flat portion for supporting the weight of the filter during removal and insertion and at least two spaced fingers extending upwardly from an upper portion thereof, wherein the fork member includes:

(i) a central body portion;

(ii) an upper fork section extending along the upper part of the central body portion with one of the upwardly extending fingers at each end;

(iii) a pair of lower forks extending downwardly and outwardly from lower corners of the central body portion;

(iv) the central body portion, upper fork section, and lower forks lying substantially in the same plane;

b) an elongated handle member; and c) a support bracket attached to the rear of said fork member and being so configured as to angularly attach the handle member to the fork member;

d) whereby when the fingers of the fork member are inserted beneath the lip of the peripheral frame, the filter may be lifted and removed from the exhaust hood with the weight of the grease filter carried by the lower flat portion of the fork member.

* * * * *